US006162115A

United States Patent [19]

Schudrich

[11] Patent Number: 6,162,115

[45] Date of Patent: Dec. 19, 2000

[54] APPARATUS AND METHOD FOR PROCESSING A SKI OR SNOWBOARD

[75] Inventor: Andreas Schudrich, Korntal-Münchingen, Germany

[73] Assignee: Products 4 U Sondermaschinenbau GmbH, Germany

[21] Appl. No.: 09/347,371

[22] Filed: Jul. 6, 1999

[30] Foreign Application Priority Data

Jul. 7, 1998 [DE] Germany ..... 198 30 251

[51] Int. Cl.[7] ..... B24B 7/00

[52] U.S. Cl. ..... 451/57; 451/65

[58] Field of Search ..... 451/57, 65, 66

[56] References Cited

U.S. PATENT DOCUMENTS

| | | | |
|---|---|---|---|
| 3,885,352 | 5/1975 | Juranitch | 451/65 |
| 5,209,780 | 5/1993 | Partel | 118/59 |
| 5,531,636 | 7/1996 | Bissen | 451/65 |
| 5,597,344 | 1/1997 | Bocquet | 451/65 |

*Primary Examiner*—David A. Scherbel
*Assistant Examiner*—Anthony Ojini
*Attorney, Agent, or Firm*—Oppenheimer, Wolff & Donnelly, LLP; Claude A. S. Hamrick

[57] ABSTRACT

The invention concerns an apparatus for processing a ski or snowboard, having a tool carrier (30) that receives a processing tool (40, 51), and having a holding device (20, 21) for holding the ski or snowboard that is to be processed, the tool carrier (30) being arranged displaceably in the longitudinal direction of the ski or snowboard. The tool carrier (30) carries at least two different processing tools **(40*a*, 40*b*, 40*c*) on a first driven shaft (34) that runs transversely to the longitudinal direction. The holding device (20, 21) is arranged shiflably transversely to the longitudinal direction, so that the ski can be brought into contact with each of the processing tools (40)**. The invention further concerns a method for processing a ski or snowboard.

10 Claims, 2 Drawing Sheets

APPARATUS AND METHOD FOR PROCESSING A SKI OR SNOWBOARD

BACKGROUND OF THE INVENTION

1. Field of the Invention

The present invention concerns an apparatus for processing a ski or snowboard, having a tool carrier that receives a processing tool, and having a holding device for holding the ski or snowboard that is to be processed.

The invention further concerns a method for processing a ski or snowboard.

2. Description of the Related Art

The document DE 43 21 449 A1 discloses an apparatus for processing the running or sliding surface and the steel edges of skis. For this purpose, the apparatus has a workstation having a rotating grinding block, along which skis that are to be processed are guided with the aid of a delivery and transport device. The delivery and transport device has a rigid guide for a ski mount. Located on the mount are resilient holding and pressing elements for joining to the respective ski. The rigid guide is arranged parallel to a predefined processing plane, and the grinding block can be adjusted at a distance from the rigid guide. This adjustability allows the processing plane to be predefined, and it is thereby possible to precisely associate multiple processing tools that are arranged one after another, i.e. in the longitudinal direction of the ski.

The document U.S. Pat. No. 5,597,344 also discloses an apparatus for processing the running surface of a ski. The apparatus comprises a plurality of processing tools being arranged transversely offset relative to the longitudinal direction of the skis. For processing the running surface, the ski is guided over the respective processing tool.

One substantial disadvantage of the aforementioned apparatuses is the fact that it requires a very large amount of floor space. Since the ski is guided over the processing tools, the apparatus has a length of at least 5 meters. This length results from doubling a maximum applicable ski length of 2.20 meters, plus a portion for the processing tool. If multiple processing steps are to be performed with the apparatus, multiple processing tools are required; this can result in a further elongation to more than 7 meters. The floor space required for such apparatuses plays a major role specifically in the case of sporting goods stores, since every additional square meter, when considered over the operating life of the apparatus, results in very high additional rental costs, especially if the sporting goods stores are sited in expensive downtown locations.

The known apparatus has various processing tools, arranged one after another in the longitudinal direction, that are each driven via separate drive units. This is disadvantageous in that multiple drive units are expensive, and a large amount of cabling work is necessary when the apparatus is set up. In addition, the maintenance outlay for multiple drive units is also high.

SUMMARY OF THE INVENTION

Against this background, the object upon which the invention is based is that of developing an apparatus of the kind cited initially in such a way that it requires as little floor space as possible and can be economically manufactured and set up, but without limiting its processing flexibility.

This object is achieved by an apparatus of the kind cited initially in which the tool carrier is arranged displaceably in the longitudinal direction of the ski or snowboard; the tool carrier carries at least two different processing tools on a first driven shaft that runs transversely to the longitudinal direction; and the holding device is arranged shiftably transversely to the longitudinal direction, so that the ski can be brought into contact with each of the processing tools.

The object of the invention is completely achieved by this apparatus.

Because the tool carrier with the processing tool is guided over the surface of the ski or snowboard that is to be processed, it is possible to decrease the lengthwise extension of the apparatus considerably, i.e. almost by half. This results in an appreciable reduction in the necessary floor space, and thus in large cost advantages that are achieved by way of reduced rental costs.

The arrangement of multiple processing tools on a single driven shaft moreover yields the advantage that costs for drive units can be decreased. The complexity of the overall apparatus also diminishes, thus also decreasing not only the setup outlay but also the outlay required for maintenance.

In a preferred development, the holding device is arranged displaceably in the direction of the processing tools.

This has the advantage that the distance between the processing tool and the surface of the ski or snowboard that is to be processed can be adjusted very easily, since the mass to be moved (i.e. the ski) is very small. This furthermore makes it possible to compensate for wear on the processing tools by way of a simply design.

In a preferred development, a second shaft, that carries at least one further processing tool and runs parallel to the first shaft and offset in the longitudinal direction, is provided.

This has the advantage that arrangement of a further processing tool makes it possible to increase the flexibility of the apparatus without increasing the design complexity to a corresponding degree. The arrangement of the processing tool on a further shaft also has the advantage that the forces acting on the two shafts and their bearings are reduced as compared to a single shaft, and that a reduction in the driven mass can be achieved because the drive systems are independent of one another.

In a preferred development, a coupling device, for example in the form of a bevel disk, that is associated with the motor and creates a connection between the motor and the first shaft and/or the second shaft, is provided.

This has the advantage that both shafts can be driven without increasing the number of drive units themselves. One motor, which drives the first and/or the second shaft via the coupling device, is sufficient; if necessary, the rotation speed can also be stepped up or down in the coupling device.

It is further preferred for the holding device to have at least one holding element. The holding device furthermore preferably has two further holding elements, the further holding elements being configured to receive a ski or snowboard in a tilted position for the processing of edges, and the other holding elements being configured for receiving a ski or snowboard in a non-tilted position for the processing of a sliding surface.

This has the advantage of making possible not only processing of the sliding surface but also processing of the edges, without changing the arrangement of the processing tools. In addition, it is thereby possible to use specific processing tools to process both the sliding surface and the edges.

Preferably the holding elements have suction elements and/or so-called pseudo-soles, which have proven particularly advantageous for holding the ski or snowboard.

The object of the invention is also achieved by a method for processing a ski or snowboard that has the steps of: clamping the ski or snowboard in a holding device; shifting the holding device transversely to the longitudinal direction of the ski or snowboard into a first desired processing position; moving a tool holder, carrying at least two processing tools, in the longitudinal direction, whereby a first processing tool is brought into engagement with the ski or snowboard; shifting the holding device transversely to the longitudinal direction into a second processing position; and moving the tool holder in the longitudinal direction, whereby a second processing tool is brought into engagement with the ski or snowboard.

The advantage of this method is that it makes possible processing of a ski or snowboard on a very small required space, since what is moved in the longitudinal direction is no longer the ski but rather the processing tool. An increase in processing flexibility can be achieved by corresponding arrangement of the processing tools, and by displacement of the ski transversely to the longitudinal direction.

In a preferred development, the holding device is shifted transversely to the longitudinal direction into a third processing position and the tool carrier is moved in the longitudinal direction, whereby a third processing tool is brought into engagement with the ski or snowboard. This has the advantage that three-stage processing of the ski is possible with little complexity, without greatly increasing the necessary floor space.

Further processing steps can, of course, also follow.

Further advantages and embodiments of the invention are evident from the description and the accompanying drawings.

It is understood that the features mentioned above and those yet to be explained below can be used not only in the respective combinations indicated, but also in other combinations or in isolation, without leaving the context of the present invention.

BRIEF DESCRIPTION OF THE DRAWING

The invention will be explained in more detail below with reference to an exemplary embodiment, referring to the drawings in which.

DETAILED DESCRIPTION OF THE INVENTION

Figure 1:
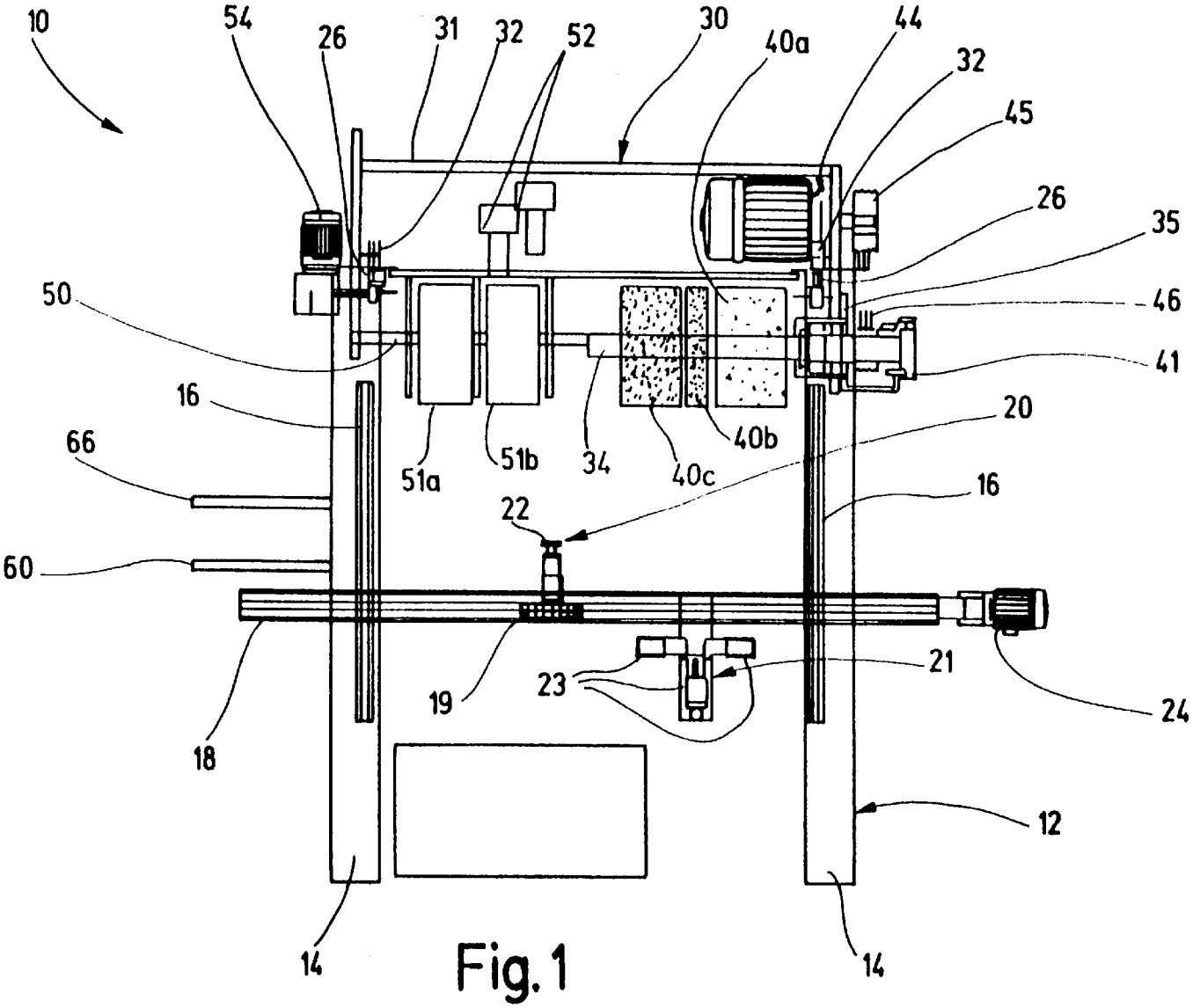
FIG. 1 shows a schematic representation of the apparatus according to the present invention in a side view.

FIG. 1 shows an apparatus, labeled with the reference number 10, for processing the sliding surface and the steel edges of a ski or snowboard. Apparatus 10 comprises a schematically indicated machine frame 12 that has at least four supports 14 running vertically and parallel to one another. Mounted on each support 14 is a rail 16, also extending in the vertical direction. Each of rails 16 guides and holds a carriage (not shown) that in turn is joined to a further rail 18. Each rail 18 is joined to carriages located opposite one another in a plane parallel to the drawing plane. This arrangement allows rails 18 to be displaced in the vertical direction.

On the horizontally extending rail 18, holding elements 20 and 21 are provided on a retaining rail 19 (FIG. 2); retaining rail 19 connects the two rails 18 and is displaceable longitudinally with respect to said rail 18. Holding element 20 comprises a suction device 22 or preferably a so-called pseudo-sole, which is configured in order to hold a ski or snowboard at the upper surface, i.e. the surface opposite the sliding surface. For this purpose, the pseudo-sole is inserted into the binding and joined to holding element 20.

In contrast thereto, holding element 21 comprises multiple suction and locking elements 23 which are configured to hold the ski or snowboard in a tilted position, i.e. with one steel edge facing upward.

Corresponding holding elements 21 are provided on retaining rail 19, spaced apart from one another in the longitudinal direction, so that a ski or snowboard can be held in apparatus 10 in such a way that the longitudinal axis of the ski or snowboard runs perpendicular to the drawing plane.

By way of a drive element (not shown) running in or on rail 18, for example an endless belt or a chain, retaining rail 19 is displaceable in the longitudinal direction of the rail by way of an electric motor 24 that is mounted at one lengthwise end of rail 18.

Drive elements are correspondingly also mounted in rails 16, and allow vertical shifting of rails 18. For reasons of clarity, however, the motor required therefor is not shown.

Apparatus 10 furthermore comprises two rails 26 running perpendicular to the drawing plane, each rail 26 being mounted on two supports 14, located one behind another in terms of the drawing plane, in their upper end region. The two rails 26 provided at the same height serve to guide and support a tool carriage 30 that can be shifted in a vertical direction with respect to the drawing plane. Tool carriage 30 comprises a frame 31 that is constructed from multiple frame elements extending horizontally and vertically. Rollers 32, which are guided in rails 26 and make the displacement possible, are provided in the region of rails 26 on frames 31.

A shaft 34 is retained rotatably, by way of a corresponding bearing 35, on frame 31 on its right side as shown in FIG. 1. Shaft 34 extends parallel to the drawing plane and at right angles to rail 26 into a central region of apparatus 10. Several, in the present exemplary embodiment three, processing tools 40*a*, 40*b*, and 40*c* are provided on shaft 34. All three processing tools 40*a* through 40*c* possess a circular shape, the center axis of shaft 34 coinciding with the respective center axis of the processing tool. In the present exemplary embodiment, processing tool 40*a* serves to grind a sliding surface of the ski, while the other two processing tools 40*b*, 40*c* serve to process the steel edges. The processing tools are correspondingly made from different materials.

To prevent processing tools 40*a* through 40*c* from tilting shaft 34 due to their weight, shaft 34 is supported at its right-hand outer end via a support device or spindle bearing 41.

Shaft 34 is driven by a motor 44 that is also connected to tool carriage 30. Motor 44 comprises a coupling device 45, for example a bevel disk, that can be brought into engagement with a mating coupling element 46 correspondingly provided on shaft 34.

FIG. 1 shows a further shaft 50 that runs parallel to shaft 34 and is arranged offset back from the latter in terms of the drawing plane. Shaft 50 is mounted rotatably on both supports 14 shown in FIG. 1, and also has, on its end facing toward motor 44, a mating coupling element (not shown). Coupling device 45 of motor 44 can also be brought into engagement with this mating coupling element of shaft 50, so that shaft 50 can also be driven.

Two processing tools 51*a*, 51*b* are arranged on this shaft 50, offset from one another in the longitudinal direction of shaft 50; it is evident from FIG. 1 that processing tools 40*a* through 40*c* are located in the right half of the apparatus, and processing tools 51*a* through 51*b* in the left half of the apparatus. Preferably the two processing tools 51 are wax belts that are used to prepare the sliding surface of a ski. In order to achieve the temperature necessary for waxing, hot-air blowers 52 are associated with the two processing tools 51.

As already mentioned, carriage 30 can be displaced in a vertical direction in terms of the drawing plane, this being made possible via a motor 54.

Figure 2:
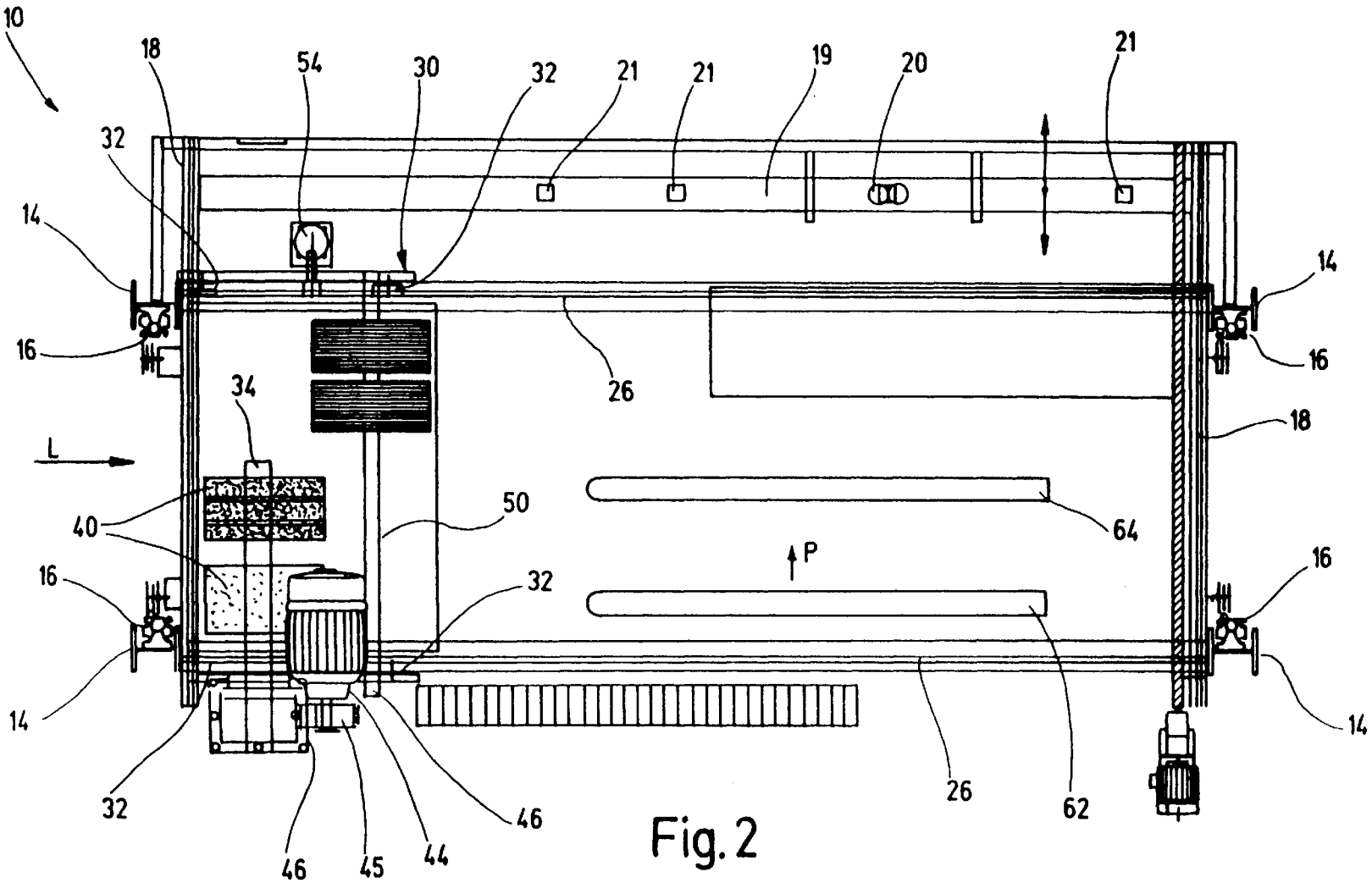
FIG. 2 shows a schematic representation of the apparatus according to the present invention in a plan view.

FIG. 2 shows the previously described apparatus 10 in a plan view; identical parts are labeled with identical reference characters and will therefore not be described again. The plan view once again illustrates that apparatus 10 comprises four supports 14 that together enclose a rectangle.

It is also clearly evident that the two shafts 34 and 50 are arranged spaced apart from one another in the longitudinal direction (labeled with an arrow L) of the apparatus. Shaft 50 is braced at both lengthwise ends on carriage 30, while shaft 34 is braced only in one longitudinal segment. This has the advantage that processing tools 40 can very easily be pulled off from shaft 34.

Apparatus 10 Performs the Following Function:

For processing of a ski (or snowboard), the latter is delivered either manually or automatically, for example by way of a loading device, to a delivery region 60. From there the ski is brought into a first processing position by displacement of retaining rail 19 into apparatus 10. The ski in the first processing position is labeled in FIG. 2 with the reference character 62. Ski 62 is held in this position while rails 18 and thus retaining rail 19 are displaced upward in order to move the upward-facing sliding surface of ski 62 into the processing plane defined by processing tools 40.

Motor 44 is then activated, and coupling device 45 is set so that shaft 34, with processing tools 40*a* through 40*c*, is driven. Then motor 54 is activated so that carriage 30 moves to the right in FIG. 2, so that after a short travel, processing tool 40*a* first comes into engagement with the left (in FIG. 2) end of ski 62. Processing tool 40*a* is moved over the sliding surface of ski 62 at an adjustable advance speed. This procedure can be performed several times if necessary.

Ski 62 is then moved lengthwise with respect to shaft 34, in the direction of arrow P, into a second processing position. In this position the ski is labeled with the reference character 64. In this second processing position, ski 64 can be processed with processing tool 40*c* by displacement of carriage 30, as described earlier.

The operation of displacing ski 62 in the direction of arrow P can be continued in accordance with the desired processing steps and the processing tools that are to be used. If processing tools 51 provided on shaft 50 are to be utilized, the engagement between coupling device 45 and mating coupling element 46 is undone and a corresponding connection is established with shaft 50. Of course it is also possible to drive both shafts 34, 50 simultaneously, by creating a rigid coupling between the motor and the two shafts.

If not only the sliding surface but also the edges of ski 62 are to be processed, ski 62 is transferred from holding element 20 to holding element 21. The appropriate processing tools are then passed over the steel edge of ski 62 that is to be processed.

As soon as processing of ski 62 is complete, it is transported into an exit region 66 that is located, as is evident from FIG. 1, above delivery region 60.

It is apparent that apparatus 10 allows complete processing of both the sliding surface and the steel edges of a ski or snowboard, and that the length of apparatus 10 needs to be only insignificantly greater than the maximum length of a ski. An apparatus that requires a very small amount of floor space is thus created. It is also apparent that only one motor 44 is required in order to drive processing tools 40, 51.

What is claimed is:

1. An apparatus for processing a ski or snowboard, having a tool carrier that receives a processing tool, and having a holding device for holding the ski or snowboard that is to be processed, wherein the tool carrier is arranged displaceably in the longitudinal direction of the ski or snowboard;

the tool carrier carries at least two different processing tools on a first driven shaft that is arranged transversely to the longitudinal direction; and the holding device is arranged shiftably transversely to the longitudinal direction, so that the ski can be brought into contact with each of the processing tools.

2. The apparatus as defined in claim 1, wherein a motor for driving the processing tools is associated with the first shaft.

3. The apparatus as defined in claim 1, wherein the holding device is arranged displaceably in the direction of the processing tools.

4. The apparatus as defined in claim 1, wherein a second shaft, that carries at least one further processing tool and runs parallel to the first shaft and offset in the longitudinal direction, is provided.

5. The apparatus as defined in claim 4, wherein a coupling device, that is associated with the motor and creates a connection between the motor and the first shaft and/or the second shaft, is provided.

6. The apparatus as defined in claim 1, wherein the holding device has at least one holding element for holding a pseudo-sole.

7. The apparatus as defined in claim 6, wherein the holding device has at least two further the further holding elements being configured to receive a ski or snowboard in a tilted position for the processing of edges, and the other holding elements being configured for receiving a ski or snowboard in a non-tilted position for the processing of a sliding surface.

8. The apparatus as defined in claim 6, wherein the holding elements have suction elements.

9. A method for processing a ski or snowboard having the steps of: clamping the ski or snowboard in a holding device;

shifting the holding device transversely to the longitudinal direction of the ski or snowboard into a first desired processing position; moving a tool holder, carrying at least two processing tools, in the longitudinal direction, whereby a first processing tool is brought into engagement with the ski or snowboard;

shifting the holding device transversely to the longitudinal direction into a second processing position; and moving the tool holder in the longitudinal direction, whereby a second processing tool is brought into engagement with the ski or snowboard.

10. The method as defined in claim 9, wherein the holding device is shifted transversely to the longitudinal direction into a third processing position and the tool carrier is moved in the longitudinal direction, whereby a third processing tool is brought into engagement with the ski or snowboard.

* * * * *